US005950826A

United States Patent [19]

Lykowski

[11] Patent Number: 5,950,826

[45] Date of Patent: Sep. 14, 1999

[54] CURLING IRON TRAVEL CASE

[76] Inventor: Barbara J. Lykowski, 604 Timberlane Dr., Kendallville, Ind. 46755

[21] Appl. No.: 08/963,906

[22] Filed: Nov. 4, 1997

Related U.S. Application Data

[60] Provisional application No. 60/030,459, Nov. 6, 1996.

[51] Int. Cl.[6] ..... A45C 11/00; B65D 30/22

[52] U.S. Cl. ..... 206/349; 206/581; 206/37; 383/40; 190/102

[58] Field of Search ..... 206/37, 38, 349, 206/581, 570, 575; 383/38, 40; 190/102, 109, 111

[56] References Cited

U.S. PATENT DOCUMENTS

| | | | |
|---|---|---|---|
| 2,551,929 | 5/1951 | Collins . | |
| 4,570,792 | 2/1986 | Conway . | |
| 4,671,393 | 6/1987 | Rainey . | |
| 4,960,204 | 10/1990 | Young et al. | 206/37 |
| 5,020,673 | 6/1991 | Adams . | |
| 5,203,456 | 4/1993 | Boswell . | |
| 5,577,607 | 11/1996 | Drake et al. | 206/581 |

FOREIGN PATENT DOCUMENTS

| | | |
|---|---|---|
| 0 313 689 A1 | 5/1989 | European Pat. Off. . |
| 6-135486 | 5/1994 | Japan . |

*Primary Examiner*—Paul T. Sewell
*Assistant Examiner*—J. Mohandesi
*Attorney, Agent, or Firm*—Randall J. Knuth

[57] ABSTRACT

A curling iron travel case which is flexible and readily disposed for placement into luggage while the curling iron remains hot. The travel case is particularly disposed to store one or more curling irons and a number of hair care accessories that a user may desire to carry along with the curling iron. The travel case is constructed of a first sheet of material, at least one row of pockets formed on one side of the first sheet, and a second sheet of material secured to the other side of the first sheet. The first sheet of material and each of the pockets are formed of a noncombustible heat resistant fabric, and the second sheet of material is a quilted fabric which provides additional insulation. One of the pockets in each of the rows is sufficiently deep completely to receive the heatable member of a curling iron. Adjacent pockets are disposed to receive the electrical cord and other hair care accessories. The travel case is provided with hook and loop type fasteners for releasably securing the travel case in a closed position.

5 Claims, 3 Drawing Sheets

CURLING IRON TRAVEL CASE

CROSS-REFERENCE TO RELATED APPLICATION

This application claims the benefit of U.S. Provisional Patent Application Ser. No. 60/030,459, filed Nov. 6, 1996.

BACKGROUND OF THE INVENTION

1. Field of the Invention

The present invention relates to carrying cases for electrical apparatus, and more particularly, to travel cases for one or more curling irons or similar electrical apparatus which retain residual heat following use of the same.

2. Description of the Prior Art

Curling irons are widely used electrical appliances that contain an electrical heating element within the operable end of the device. The operable end of the curling iron typically contains a cylindrical tube formed of a thermally conductive material, and a semi-cylindrical member hingedly connected to the cylindrical tube. The semi-cylindrical member is used to compress hair against the cylindrical tube portion as the hair is wrapped around the cylindrical tube. By compressing the hair against the cylindrical tube, heat from the tube causes the hair to set into a loose curl.

Following use of the curling iron, the iron usually is left on a countertop or other horizontal surface for a substantial cool down period. During normal day to day operations, the cooling down of the iron presents no problems for its users. While traveling, however, a curling iron can be a significant inconvenience. Because of the residual heat in the curling iron, it cannot simply be stowed in a suitcase or other kit where items which may be damaged are in close proximity to the heated iron. To overcome this problem, the prior art contains several examples of curling iron travel cases which may be used to store a hot curling iron. The prior art, however, fails to provide a curling iron travel case which is particularly useful in that all hair maintenance devices and materials may be carried in a single travel case. Thus, there is a need for a travel case for curling irons which may be used to store one or more hot curling irons and other hair maintenance devices and materials.

U.S. Pat. No. 5,203,456 which issued to Rudy Boswell on Apr. 20, 1993, discloses a hard travel case having a number of troughs for receiving curling irons, a well for receiving a power strip with multiple outlets, and a well for receiving power cords for the curling irons and the power strip. The troughs for receiving curling irons contain a heat resistant sleeve for supporting the hot tip of the curling iron during or following use. The heat resistant sleeve preferably is formed of a ceramic material.

U.S. Pat. No. 4,570,792 which issued to Kay S. Conway on Feb. 18, 1986, discloses a travel case for stowing a curling iron. The travel case comprises an insulative sheath formed of an insulative heat resistant inner liner and a flexible outer covering. The sheath has an open end with a flap for selectively closing the open end, and a tie strap for securing the curling iron power cord to the outside of the sheath.

Another piece of prior art which is commercially available (but for which no written disclosure is available) includes a travel case for collapsible curling irons that may break down into separable components. The travel case includes separate pockets lined with a heat-resistant metal-coated fabric, whereby each pocket is disposed to receive a single component of the curling iron. Upon folding, hook and loop type fasteners releasably secure the travel case in a closed position.

Japanese Patent Application No. 6-135486(A) by Seiichi Nakada, published on May 17, 1994, discloses a packing device for safely transporting an electrical iron and its stand. In a common box, the iron is placed into the bottom of the box and an intermediate partition separates the upper portion of the box where the iron stand is stored.

Other prior art carrying cases exist for carrying other items. U.S. Pat. No. 2,551,929 which issued to Ralph D. Collins on May 8, 1951, discloses an automobile jack and cover having a plurality of opposed confronting pockets for receiving various components of the automobile jack. U.S. Pat. No. 5,020,673 which issued to David R. Adams on Jun. 4, 1991, discloses a carrying case for personal items. The carrying case comprises a tri-folding semi-rigid cover with a number of closable pockets for receiving various personal items. U.S. Pat. No. 4,671,393 which issued to Robert D. Rainey on Jun. 9, 1987, discloses a mat foldable into an insulated bag which has corresponding opposed handles that may be secured together with hook and loop closure means. European Patent Application No. 313,689(A) by Allan Thomas, published on May 3, 1989, discloses a disposable kit for toiletry and like products. One embodiment discloses a foldable kit having a plurality of pockets and pouches for storing various toiletry articles.

None of the above inventions and patents, taken either singly or in combination, is seen to describe the instant invention as claimed.

SUMMARY OF THE INVENTION

The present invention involves curling iron travel cases which are flexible and readily disposed for placement into luggage while the curling iron remains hot. The travel case is particularly disposed to store one or more curling irons and a number of hair care accessories that a user may desire to carry along with the curling iron. The travel case for curling irons according to the present invention comprises an inner sheet of material, at least one row of pockets formed on an inner side of the inner sheet, and a outer sheet of material secured to the outer side of the inner sheet. The inner sheet of material and each of the pockets are formed of a noncombustible heat resistant fabric. The outer sheet of material is a quilted fabric which provides additional insulation for the storage of a hot curling iron.

According to one embodiment, a first row of pockets is formed along one side edge of the travel case and a second row of pockets is formed along the opposite side of the travel case, whereby the pockets of each row are in opposed confronting relation. One of the pockets on each side is deeper than the other pockets and therefore is particularly disposed completely to receive the heatable member of a curling iron. Those pockets disposed to receive the heatable member are located opposite one another. Adjacent each of the pockets disposed to receive the heatable member is another pocket disposed to receive the electrical cord of each curling iron. Additional pockets are provided within each row of pockets for the storage of accessories. The travel case is provided with securing means, such as hook and loop type fasteners, for releasably securing the travel case in a closed position where handles on each end of the travel case are aligned.

According to another embodiment, a row of pockets is formed along one end of the travel case. One of the pockets is sufficiently deep completely to receive the heatable member of a curling iron. Adjacent the pocket disposed to receive the heatable member is another pocket disposed to receive the electrical cord of the curling iron and any accessories. The travel case is provided with securing means, such as hook and loop type fasteners, for releasably securing the travel case in a closed position. A handle on the end opposite the row of pockets allows the travel case to hang with its pockets having their open ends exposed upwardly, whereby the curling iron and accessories are conveniently accessible.

Accordingly, it is a principal object of the invention to provide a travel case for curling irons that may be used to store one or more curling irons and various accessories for dressing hair.

It is also an object of the invention to provide a travel case for curling irons which is flexible and capable of being packed into luggage.

It is another object of the invention to provide a travel case for curling irons which may be used to store a hot curling iron without damaging accessories in the travel case or other items contained in a piece of luggage.

It is a further object of the invention to provide a travel case for curling irons which may be conveniently hung to render the curling irons and accessories accessible for use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
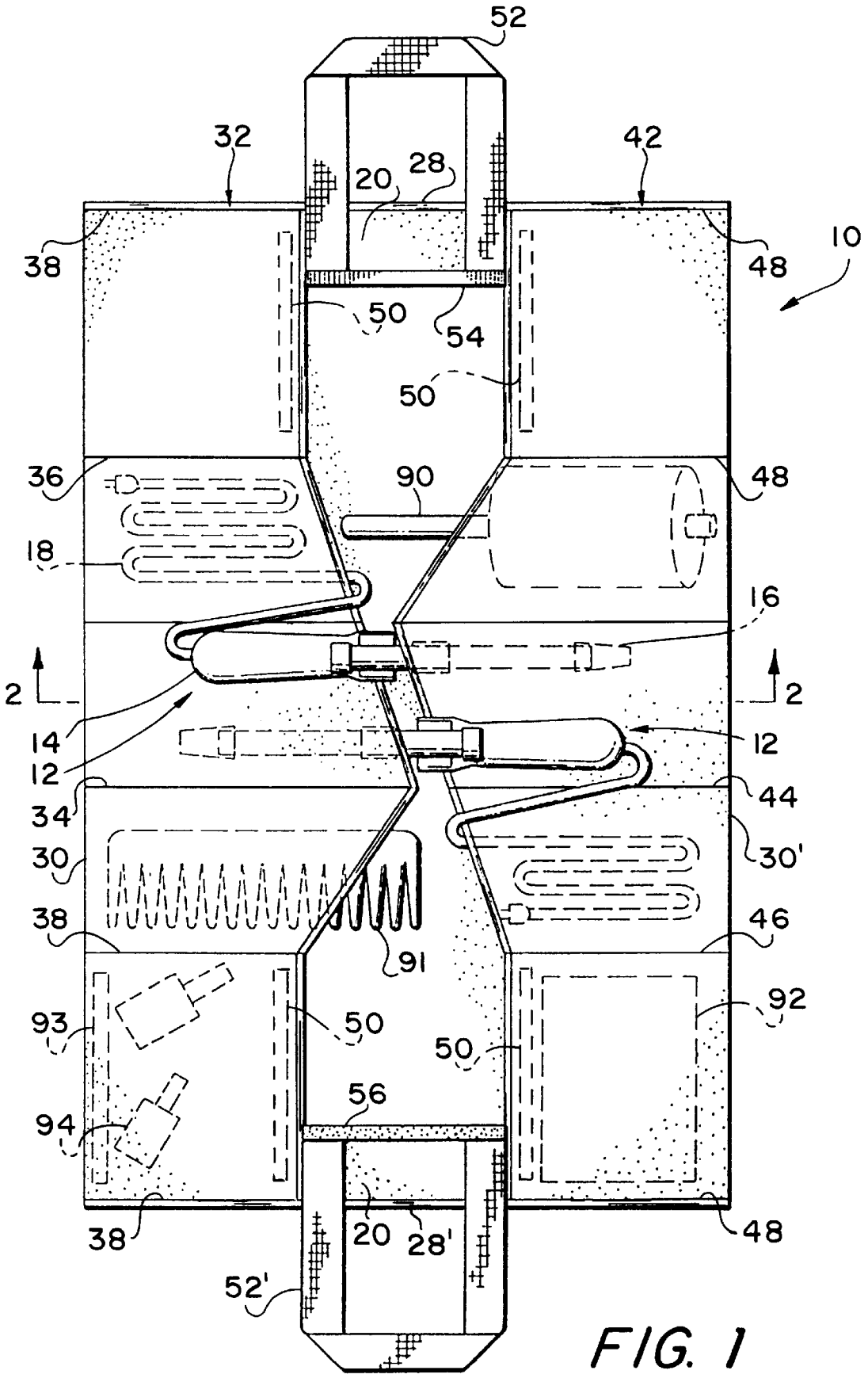
FIG. 1 is top plan view of a first embodiment of the present invention which shows the foldable travel case having a plurality of opposed pockets for receiving curling irons and miscellaneous hair maintenance devices and materials.
Figure 2:
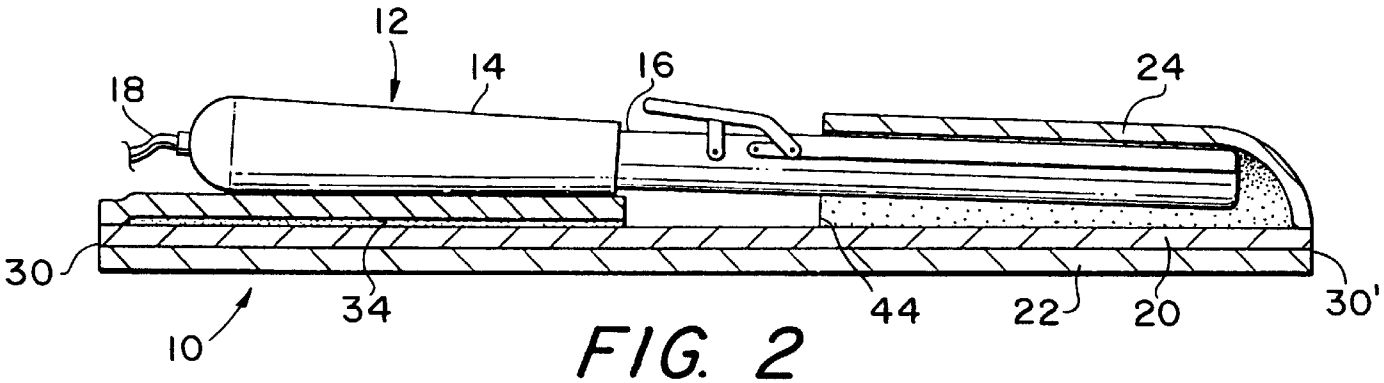
FIG. 2 is an enlarged cross sectional view of the first embodiment according to line 2—2 in FIG. 1 and looking in the direction of the arrows.

Referring now to the figures by numerals of reference, and first to FIGS. 1 and 2, 10 denotes generally a travel case according to the present invention which may be used to store curling irons or similar devices. The travel case 10 is disposed to receive a curling iron 12 immediately following its use; and upon stowing the case in luggage, the travel case 10 protects the surrounding environment from residual heat retained by the curling iron. Conventional curling irons have a handle portion 14 connected to a heatable member 16 extending generally from the other end of the handle and a flexible power cord 18 extending from the handle. A heating element internal to the heatable member 16 causes the heatable member to reach temperatures sufficient to achieve the curling of hair. However, such heat is also sufficient to cause significant damage, upon direct contact, to clothing or other travel accessories.

Referring specifically now to FIG. 2, the travel case 10 generally comprises a first (inner) sheet 20 of flexible material, a plurality of pockets 24 formed on the inner side of the inner sheet, and an outer (outer) sheet 22 of flexible material secured to the outer side of the inner sheet. The inner and outer sheets of material, and the plurality of pockets preferably are sewn together, as discussed hereinafter, using a conventional and durable stitching pattern. The material used for the inner sheet 20 and the plurality of pockets 24 is preferably a noncombustible heat resistant fabric. The noncombustible heat resistant fabric is selected from the group consisting of ceramic cloth, fiberglass cloth, polymerized thermoplastic cloth, and a metal coated cloth. Of these, conventional metal coated cloth is preferred because of its cost and reliability. Typical metal coated cloth is of the type used for oven mitts and ironing board covers. Regardless of the type of material used to form the inner sheet 20 and the pockets 24 thereon, the critical feature is that the cloth be noncombustible within the temperature range of all curling irons currently available in the market. The outer sheet 22 of material, secured to the outer side of the inner sheet, provides additional insulation and decorative appeal for the travel case 10. A quilted fabric mat is preferable for the outer sheet of material, because it is relatively inexpensive and effective for its desired purposes.

Referring again to FIG. 1, the inner sheet 20 has opposed ends 28, 28' with opposed side edges 30, 30' intermediate and extending between the opposed ends. Connected to the inner side of the inner sheet 20 is a first row of pockets 32 which extends along an entire side edge 30. The first row 32 includes a pocket 34 for receiving the heatable member 16 of the curling iron, and a pocket 36 adjacent the pocket 34 for receiving the flexible power cord 18 of the curling iron 12. Additional pockets 38 are provided alongside the curling iron pockets 34 and 36 for storage of accessories such as brushes 90, combs 91, and mirrors 92. Also connected to the inner side of the inner sheet 20 is a second row of pockets 42 which extends along the entire opposed side edge 30'. The second row of pockets has a pocket 44 for receiving the heatable member 16 of a second curling iron 12, and a pocket 46 adjacent thereto for receiving the flexible power cord 18 of the curling iron 12. Additional pockets 48 are provided alongside the second pair of curling iron pockets 44 and 46 for storage of accessories as described above. To prevent any small accessories from falling out of the additional pockets 38 and 48, the additional pockets are provided with closure means 50 in the form of hook and loop fasteners secured to overlapping surfaces of the pockets and the inner sheet 20.

Each of the pockets in the first row 32 is open at the end thereof adjacent the second row of pockets 42, and each of the pockets in the second row 42 is open at the end thereof adjacent to the first row of pockets 32. Thus, the pockets of the first row 32 and the pockets of the second row 42 have their open ends in spaced, confronting relation with each other. For instance, the pocket 34 containing the heatable element 16 of the first curling iron 12 is in opposed confronting relation to the pocket 44 containing the heatable element 16 of the second curling iron 12. Because the pockets 34 and 44 are disposed to receive the heatable member of a curling iron, each of these pockets is significantly deeper than the other pockets of the travel case 10. The open ends of the pockets in each row are sloped or tapered to ensure that the pockets 34 and 44 are as deep as the travel case allows. Thus, the depth of the pockets 34 and 44 allows for complete enclosure of the heatable element 16, which protects any accessories and other materials against the residual heat of the heatable member.

When the heatable element 16 of one curling iron 12 is placed into the pocket 34, the handle 14 of the curling iron 12 rests upon the opposing pocket 44. Likewise, when the heatable element 16 of another curling iron 12 is placed into the pocket 44, the handle of the other curling iron rests upon the opposing pocket 34. To prevent any entanglement of the two curling irons, the power cord 18 of each curling iron 12 is inserted into the pocket immediately adjacent the curling iron (i.e., the pockets 36 and 46, respectively).

Figure 3:
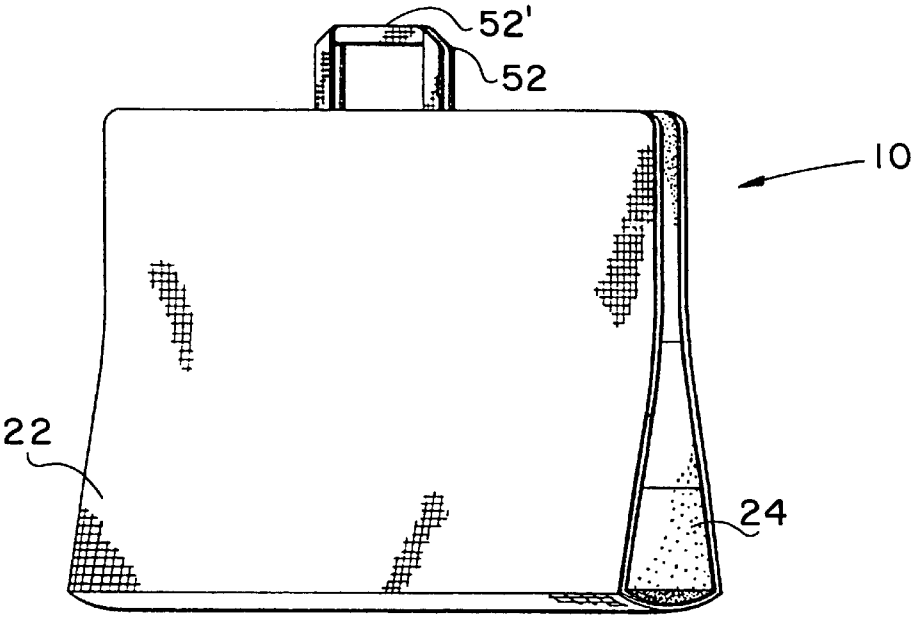
FIG. 3 is a perspective view of the first embodiment shown in its folded position.

Secured to one end 28 of the inner sheet is a first handle 52, and secured to the other end 28' of the inner sheet is a second handle 52'. Handles 52, 52' are disposed to align with one another upon the folding of the travel case 10, thereby allowing a user to carry the case with ease. To maintain the case in its folded position as shown in FIG. 3, with the handles 52, 52' properly aligned, securing means are provided at each of the opposed ends 28, 28' for releasably fastening together the opposed ends. Preferred securing means include a hook type fastener 54 attached adjacent one end 28 of the inner sheet and a loop type fastener 56 attached adjacent the other end 28' of the inner sheet. When the case is folded, as shown in FIG. 3, the hook and loop type fasteners mate to prevent unwanted unfolding of the case.

To assemble the travel case 10 according to the present invention, the inner and outer sheets of material 20 and 22, respectively, are cut to size and the materials used to form the first and second rows of pockets also are cut to size. Materials used to form the first and second rows of pockets are individually sewn to opposed side edges 30, 30' and partially along the opposed ends 28, 28' of the inner sheet. To form the various pockets in each of the first and second rows 32, 42, stitched seams are used to separate adjacent pockets. Following creation of the first and second rows, the handles 52, 52' are sewn to the inner sheet at the opposed ends 28, 28' thereof, respectively. Hook and loop fasteners 54 and 56 also are sewn to the first inner sheet so that they will align and mate when the travel case is subsequently folded. Closure means, also in the form of hook and loop fasteners, may be secured to any additional pockets 38, 48 (i.e., those pockets on each end of the first and second rows) and on the inner sheet so that they are in position to mate with one another. Finally, the outer sheet 22 of material is secured to the outer side of the inner sheet 20 to provide a decorative exterior. The seams between the inner and outer sheets should be created along the ends and side edges, over which bias tape may be sewn to provide a clean, finished appearance.

Figure 4:
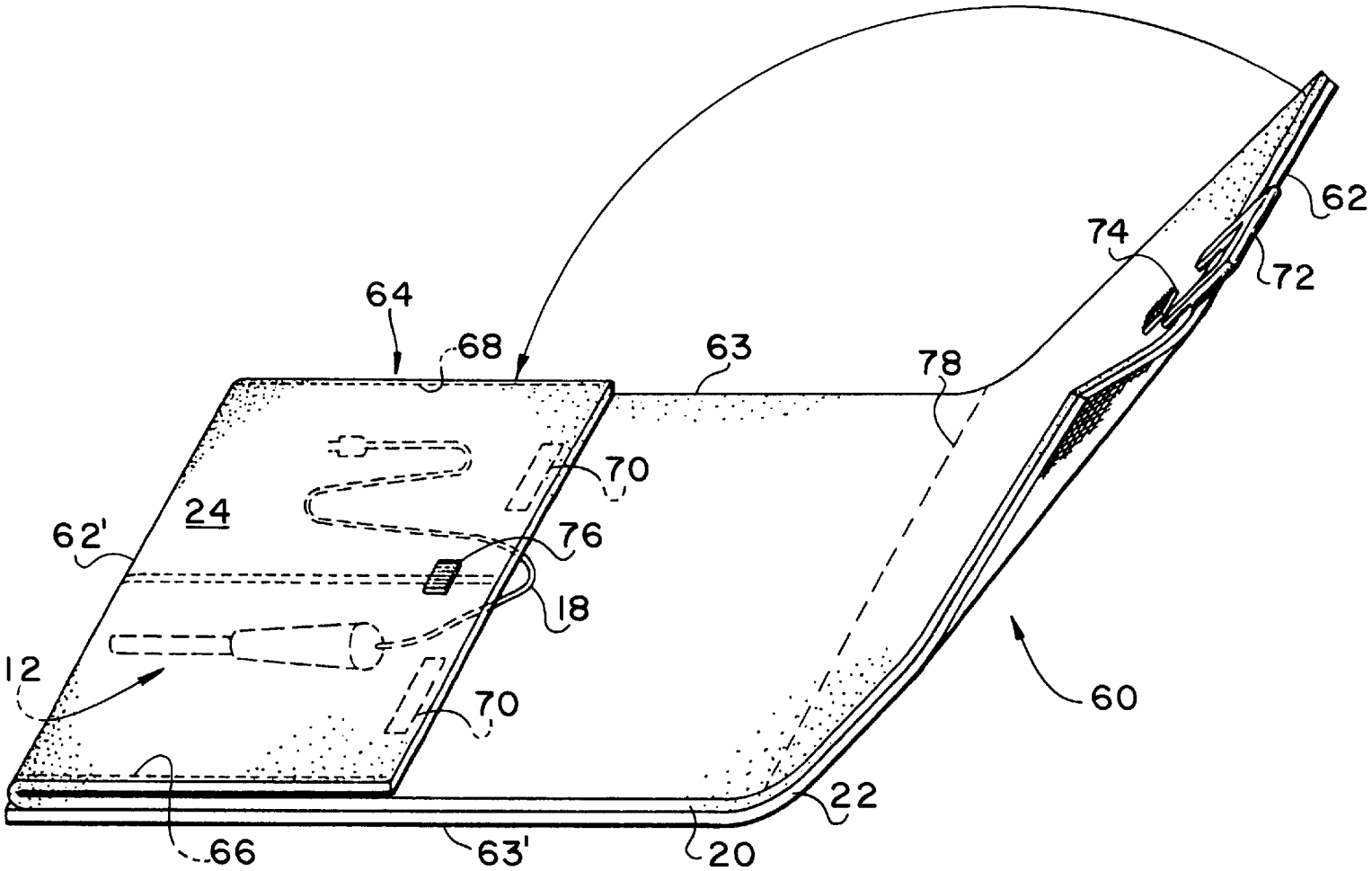
FIG. 4 is a perspective view of a second embodiment of the present invention.

Referring now to FIG. 4, 60 denotes generally a travel case according to another embodiment of the present invention which may be used to store curling irons or similar devices. The travel case 60 is disposed to receive a curling iron 12 immediately following its use, and upon stowing the case in luggage, the travel case 60 protects the surrounding environment from residual heat retained by the curling iron. Because of the arrangement of pockets, travel case 60 is particularly disposed for hanging on a door hanger or the like so that the curling iron 12 and any accessories are readily available for use.

In a manner similar to the first embodiment, the travel case 60 generally comprises an inner sheet 20 of flexible material, a plurality of pockets 24 formed on the inner side of the inner sheet, and an outer sheet 22 of flexible material secured to the outer side of the inner sheet. As in the first embodiment, the inner and outer sheets of material and the plurality of pockets preferably are sewn together using a conventional durable stitching pattern. Also, the material used for the inner sheet 20 and the plurality of pockets 24 is preferably a noncombustible heat resistant fabric, such as those discussed above.

The inner sheet 20 has opposed ends 62, 62' with opposed side edges 63, 63' intermediate and extending between the opposed ends. Connected to the inner side of the inner sheet is a row of pockets 64 extending along one end 62' of the inner sheet. The row of pockets 64 includes a first pocket 66 for receiving the curling iron and a second pocket 68 adjacent to the first pocket. The first pocket is sufficiently deep to receive at least the heatable member of the curling iron, and preferably the entire curling iron. The second pocket 68 is sufficiently large to receive the flexible power cord of the curling iron and any accessories that a user may desire to carry (i.e., brushes, combs, mirrors, makeup, and hair care products). To prevent any small accessories from falling out of the second pocket, closure means 70 in the form of hook and loop fasteners are secured to facing surfaces of the second pocket 68 and the inner sheet 20. Similar closure means 70 are provided for the first pocket 66.

Each of the pockets in the row 64 is open at the end thereof nearest the other end 62 of the inner sheet. This allows the open end of the pockets to be exposed upwardly when the travel case is hung in the open position. Exposure of the pockets with their open ends upwards renders the curling iron and any accessories accessible to a user. To allow the travel case to hang from a hook or the like, a handle 72 is secured to the end 62 of the inner sheet. The handle 72 preferably is a closed loop handle formed of a flexible fabric web, which allows the handle to fit over the hook or a similar hanging agent.

To maintain the case closed in a folded position, securing means are provided at each of the opposed ends 62, 62' for releasably fastening together the opposed ends. Preferred securing means include a hook type fastener 74 attached adjacent one end 62 of the inner sheet, and a loop type fastener 76 attached adjacent the other end 62' of the inner sheet. When the case is folded, along the line 78 and in the direction of the arrow, the hook and loop type fasteners mate to prevent unwanted opening of the case.

To assemble the travel case 60, the inner and outer sheets of material 20 and 22, respectively, are cut to size, with the inner sheet cut longer than the outer sheet. To form the row of pockets 64, the portion of the inner sheet which is longer than the outer sheet is folded or doubled onto itself and sewn in place. The various pockets in the row are formed by stitched seams, which are used to separate adjacent pockets. Following creation of the first row, the handle 72 is sewn to the inner sheet at the end 62 thereof. Hook and loop fasteners 74 and 76 also are sewn to the inner sheet so that they will align and mate when the travel case is subsequently folded, as discussed above. Closure means, also in the form of hook and loop fasteners, may be secured to the first and second pockets, and on the inner sheet so that they are in position to mate with one another. Finally, the outer sheet 22 of material is secured to the outer side of the inner sheet 20 to provide a decorative exterior. The seams between the inner and outer sheets should be created along the ends 62, 62' and side edges 63, 63', over which bias tape may be sewn to provide a clean, finished appearance.

It is to be understood that the present invention is not limited to the several embodiments described above, but encompasses any and all embodiments within the scope of the following claims.

I claim:

1. A carrying case for storing at least two curling irons, each curling iron having a handle portion, a heatable member, and a power cord, said carrying case comprising:

an outer sheet of flexible material, said outer sheet having an outer side;

an inner sheet of flexible, noncombustible heat-resistant fabric, said inner sheet having an inner side, an outer side, a first end, an opposing second end, a first side edge, and an opposing second side edge, said outer side of said inner sheet being attached to said outer sheet by stitching;

a first row of pockets and a second row of pockets, each of said first and second rows of pockets being composed of flexible, noncombustible heat-resistant fabric, said fabric of said first and second rows of pockets being attached by stitching to said inner side of said inner sheet with heat-resistant non-combustible thread, said fabric of said first and second rows of pockets being attached to said first and second side edges respectively along the entire length of said first and second side edges, said first row of pockets including a first pocket, a second pocket, and at least two additional pockets, said second row of pockets including a third pocket, a fourth pocket, and at least two additional pockets, each of said pockets being separated by stitched seams, said first pocket lying adjacent to said second pocket, said third pocket lying adjacent to said fourth pocket, said additional pockets of said first row of pockets flanking said first and second pockets, said additional pockets of said second row of pockets flanking said third and fourth pockets, each pocket having one open edge, said open edges of said pockets of said first row of pockets being adjacent to said open edges of said pockets of said second row of pockets, said open edges of at least two of said pockets in each of said first and second rows of pockets lying at an angle with respect to said first and second side edges respectively, said open edge of said first pocket being in opposed confronting relation with said open edge of said third pocket, so that said first and third pockets are significantly deeper than said second, fourth, and additional pockets, said first pocket being adapted to receive one of the heatable members so that the corresponding handle portion rests upon said third pocket, said third pocket being adapted to receive one of the heatable members so that the corresponding handle portion rests upon said first pocket, each of said second and fourth pockets being adapted to receive one of the power cords, each of said additional pockets being adapted to hold accessories selected from the group consisting of combs, brushes, and mirrors, at least one of said additional pockets including closure means for preventing small accessories from falling out, said closure means being hook and loop fastener;

first and second handles attached to said first and second ends, respectively; and securing means for releasably securing said first and second ends, said securing means being at least two mating strips of hook and loop fastener affixed to said inner side of said inner sheet.

2. The case recited in claim 1, further including a decorative sheet attached to said outer side of said outer sheet.

3. The case recited in claim 1, wherein said noncombustible heat-resistant material is selected from the group consisting of ceramic cloth, fiberglass cloth, and polymerized thermoplastic cloth.

4. The case recited in claim 1, wherein said noncombustible heat-resistant material is metal-coated cloth.

5. The case recited in claim 1, wherein each of said first and second handles is a closed loop formed of a flexible fabric.

* * * * *